US010265998B2

(12) United States Patent
Nakajima

(10) Patent No.: US 10,265,998 B2
(45) Date of Patent: Apr. 23, 2019

(54) PENCIL CUTTING TOOL

(71) Applicant: NAKAJIMA JUKYUDO CO., LTD., Matsubara-shi, Osaka (JP)

(72) Inventor: Junya Nakajima, Matsubara (JP)

(73) Assignee: NAKAJIMA JUKYUDO CO., LTD, Matsubara-shi, Osaka (JP)

( * ) Notice: Subject to any disclaimer, the term of this patent is extended or adjusted under 35 U.S.C. 154(b) by 85 days.

(21) Appl. No.: 15/521,172

(22) PCT Filed: Oct. 30, 2015

(86) PCT No.: PCT/JP2015/080640
§ 371 (c)(1),
(2) Date: Apr. 21, 2017

(87) PCT Pub. No.: WO2016/084549
PCT Pub. Date: Jun. 2, 2016

(65) Prior Publication Data

US 2017/0313123 A1 Nov. 2, 2017

(30) Foreign Application Priority Data

Nov. 26, 2014 (JP) ..... 2014-238330

(51) Int. Cl.
*B43L 23/08* (2006.01)
*B43K 15/00* (2006.01)
*B43K 23/06* (2006.01)

(52) U.S. Cl.
CPC ..... *B43L 23/08* (2013.01); *B43K 15/00* (2013.01); *B43K 23/06* (2013.01)

(58) Field of Classification Search
CPC ..... B43L 23/08; B43K 15/00; B43K 23/06
See application file for complete search history.

(56) References Cited

U.S. PATENT DOCUMENTS 329,486 A * 11/1885 Price ..... B43L 23/08 30/454
2004/0261275 A1* 12/2004 Fregeolle ..... B43K 23/001 30/457
2012/0017451 A1* 1/2012 Luettgens ..... B43L 23/08 30/457

FOREIGN PATENT DOCUMENTS

DE 960783 C * 3/1957
JP 2007283739 A * 11/2007
JP 2009-269323 A 11/2009

OTHER PUBLICATIONS

English translation of the International Search Report of PCT/JP2015/080640.

* cited by examiner

*Primary Examiner* — Stephen Choi
(74) *Attorney, Agent, or Firm* — Muncy, Geissler, Olds & Lowe, P.C.

(57) ABSTRACT

A pencil cutting tool 1 comprising a recess forming part 10 for boring a connecting recess 52 in an end face 51 of a pencil 50, wherein the recess forming part 10 comprises a main body 11 having a cylindrical insertion hole 12 for insertion of an end of the pencil 50 and a boring blade 40 disposed inside the insertion hole 12 so as to come into contact with the end face 41 of the pencil 50, the boring blade 40 has a semicircular cross section and a flat surface **40*a* extending along the axial line of the insertion hole 12, and the main body 11 has a discharge part 13 that is formed so as to face the flat surface 40*a* to discharge shavings from the insertion hole 12**.

4 Claims, 7 Drawing Sheets

PENCIL CUTTING TOOL

TECHNICAL FIELD

The present invention relates to a pencil cutting tool and, more specifically, relates to a pencil cutting tool for boring a connecting recess in the end face of a pencil.

BACKGROUND ART

It is difficult to continue using a pencil as-is as the pencil becomes too short by using it, and, accordingly, research has been conducted to utilize a plurality of shortened pencils by connecting them. For example, Patent Literature 1 discloses a pencil cutting tool comprising a drill for forming a recess in the end face of a pencil and a blade for forming a protrusion on another pencil to be fitted into the recess. As shown in FIG. 12, a drill 101 has a spiral groove 102 and is secured by a pin 104 so as to project inside a guiding hole 103, and rotating a pencil 105 while pressing it onto the drill 101 forms a recess 106 in the end face of the pencil 105.

CITATION LIST

Patent Literature

Patent Literature 1: JP 2009-269323A

SUMMARY OF INVENTION

Technical Problem

However, the above conventional drill 101 is problematic in that the operability is poor because shavings of the pencil 105 resulting from forming the recess 106 are not smoothly discharged through a discharge hole 107 to the outside and are likely to build up in the guiding hole 103.

Accordingly, an object of the present invention is to provide a pencil cutting tool with which a pencil connecting recess can be promptly and easily formed.

Solution to Problem

The aforementioned object of the present invention is achieved by a pencil cutting tool comprising a recess forming part for boring a connecting recess in an end face of a pencil, wherein the recess forming part comprises a main body having a cylindrical insertion hole for insertion of an end of the pencil and a boring blade disposed inside the insertion hole so as to come into contact with the end face of the pencil; the boring blade has a semicircular cross section and a flat surface extending along an axial line of the insertion hole; and the main body has a discharge part that is formed so as to face the flat surface to discharge shavings from the insertion hole.

It is preferable that the pencil cutting tool further comprises a columnar retaining member that is accommodated in the insertion hole and retains the boring blade in the insertion hole. It is preferable for the retaining member that a supporting part supporting the boring blade is cut in a semicylindrical shape and has a guiding surface that is flush with the flat surface; a step capable of coming into contact with the end face of the pencil is formed between the supporting part and the boring blade; and the discharge part extends to a position where the discharge part faces the guiding surface.

It is preferable that the pencil cutting tool further comprises a cylindrical covering member that accommodates the boring blade and the supporting part. It is preferable that the covering member has a semicircular insertion part into which the boring blade and the supporting part are capable of being inserted, and has a connecting part that is in communication with the discharge part in a position where the connecting part faces the flat surface and the guiding surface.

Advantageous Effects of Invention

According to the pencil cutting tool of the present invention, a pencil connecting recess can be promptly and easily formed.

DESCRIPTION OF EMBODIMENTS

Figure 1:
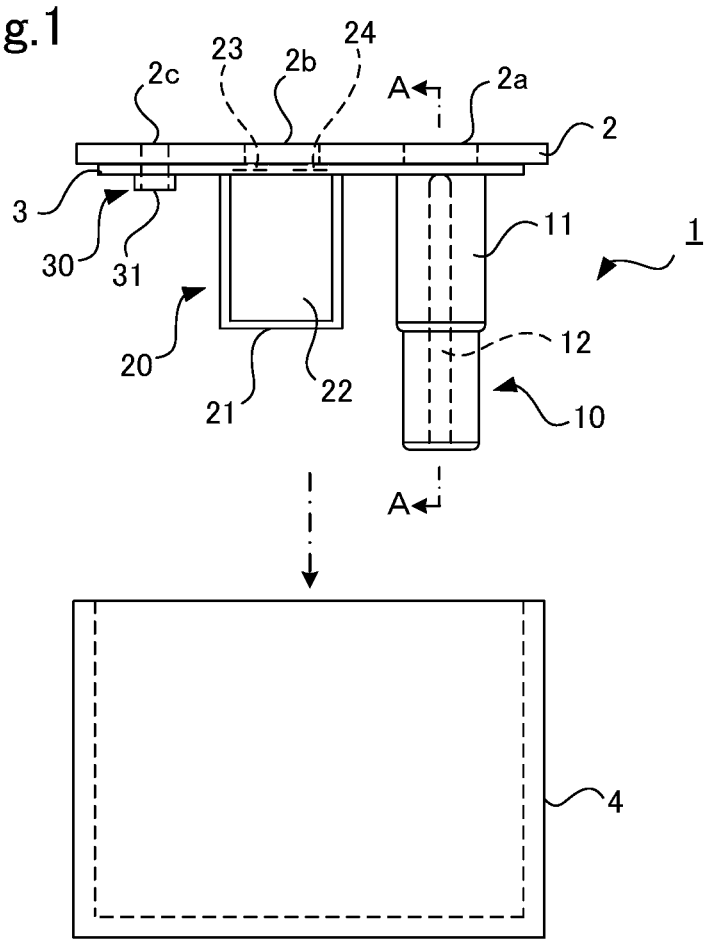
FIG. 1 is an exploded side view of a pencil cutting tool according to one embodiment of the present invention.
Figure 2:
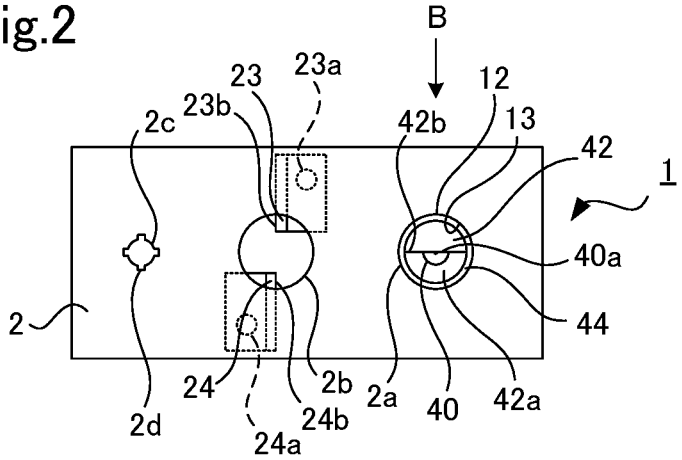
FIG. 2 is a front view of the pencil cutting tool shown in FIG. 1.

Below, embodiments of the present invention will now be described with reference to the appended drawings. FIG. 1 is an exploded side view of a pencil cutting tool according to one embodiment of the present invention, and FIG. 2 is a front view of the pencil cutting tool shown in FIG. 1. As shown in FIG. 1, a pencil cutting tool 1 is configured such that a recess forming part 10, a protrusion forming part 20, and a protrusion smoothing part 30 are integrated by a lid 2, and a fitting ring 3 provided on the back surface of the lid 2 is fitted to the opening of a casing 4.

The recess forming part 10 comprises a cylindrical main body 11 that has a closed bottom and is fixed to the back surface of the lid 2. Substantially the entire side surface of the main body 11 has a slit-shaped discharge part 12 in the longitudinal direction. As shown in FIG. 2, the inside of the main body 11 is a cylindrical insertion hole 13 that is in communication with an opening 2*a* of the lid 2, and a boring blade 40 retained by a retaining member 42 is accommodated in the insertion hole 13 via the opening 2*a*. The boring blade 40 is tapered, has a semicircular cross section along the entire length, and has a flat surface 40*a* extending in the axial direction of the insertion hole 13. The flat surface 40*a* is disposed so as to face the discharge part 12.

Figure 3:
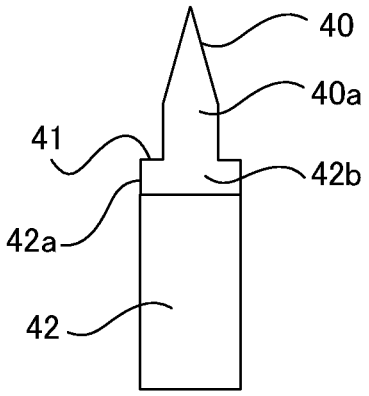
FIG. 3 is a cross-sectional view showing principal parts of the pencil cutting tool shown in FIG. 1.

FIG. 3 is a side view of the boring blade 40 and the retaining member 42 shown in FIG. 1 as viewed from the direction of arrow B in FIG. 2 (from the discharge part 12 side in FIG. 1). As shown in FIGS. 2 and 3, the retaining member 42 has a columnar shape, and the upper part is a supporting part 42*a* that supports the boring blade 40. The supporting part 42*a* is cut in a semicylindrical shape and has a guiding surface 42*b* that is flush with the flat surface 40*a* of the boring blade 40. The proximal-side cross section of the boring blade 40 has a smaller diameter than the cross section of the supporting part 42*a*, and a step 41 is formed between the boring blade 40 and the supporting part 42*a*.

Figure 4:
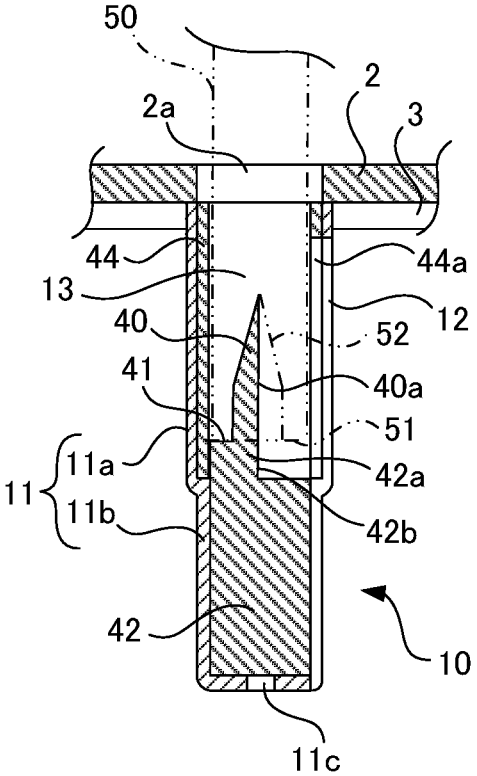
FIG. 4 is a side view showing principal parts of the pencil cutting tool shown in FIG. 1.

FIG. 4 is a cross-sectional view of the recess forming part 10. The main body 11 has a shape obtained by joining a large-diameter part 11*a* and a small-diameter part 11*b*, the diameter of the opening of which is smaller than that of the large-diameter part 11*a*. The retaining member 42 is firmly fitted to the inner circumferential surface of the small-diameter part 11*b*. The boring blade 40 and the supporting part 42*a* are covered with a cylindrical covering member 44, and the outer circumferential surface of the covering member 44 is firmly attached to the inner circumferential surface of the large-diameter part 11*a*. The side surface of the covering member 44 has a connecting part 44*a* in a position where it faces the flat surface 40*a* of the boring blade 40 and the guiding surface 42*b* of the supporting part 42*a*, and aligning the connecting part 44*a* with the discharge part 12 of the main body 11 brings the inside of the covering member 44 into communication with the outside of the main body 11. The bottom part of the main body 11 has an air release hole 11*c* for facilitating the accommodation of the retaining member 42 in the small-diameter part 11*b*.

Figure 5:
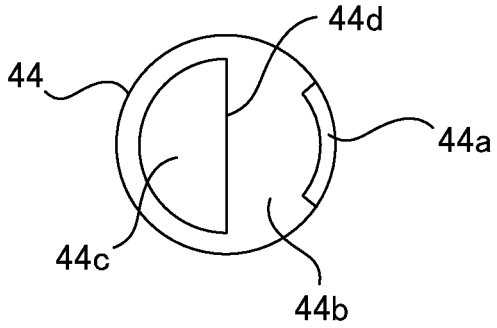
FIG. 5 is an underside view showing principal parts of the pencil cutting tool shown in FIG. 1.

FIG. 5 is an underside view of the covering member 44. A bottom part 44*b* of the covering member 44 has an insertion part 44*c* composed of a semicircular opening. The insertion part 44*c* has substantially the same size and shape as the cross section of the supporting part 42*a*. Inserting the supporting part 42*a* into the insertion part 44*c* causes the supporting part 42*a* to be firmly attached to the circumference of the insertion part 44*c*, and the boring blade 40 to be retained inside the covering member 44. The connecting part 44*a* of the covering member 44 is formed in a position where it faces a linear part 44*d* that constitutes the edge of the insertion part 44*c*.

As shown in FIGS. 1 and 2, the protrusion forming part 20 comprises a pair of flat blades 23, 24 inside a cover 21 that is fixed to the back surface side of the lid 2. The flat blades 23, 24 are fixed to the back surface of the lid 2 by fixing pins 23*a*, 24*a*, respectively, so as to be partially exposed from an opening 2*b* formed in the lid 2, and, as will be described below, form on a pencil a tapered protrusion that has a diameter corresponding to the space between the flat blades. Shavings of a pencil produced when forming the protrusion are discharged through an opening 22 formed in the side surface of the cover 21. Linear blade edges 23*b*, 24*b* of the flat blades 23, 24 are disposed such that the respective extension lines cross the center of the opening 2*b* and overlap each other so as to be able to perform stable shaving, with one mainly performing shaving and the other mainly functioning as a scraper.

As shown in FIGS. 1 and 2, the protrusion smoothing part 30 comprises a cylinder 31 that is in communication with an opening 2*c* of the lid 2, and smoothes the outer circumferential surface of the protrusion by removing burrs and the like when the protrusion formed on a pencil by the protrusion forming part 20 is slid on the inner circumferential surface of the cylinder 31. The opening 2*c* and the cylinder 31 have a plurality of pockets 2*d* provided by partially increasing the diameters to facilitate the removal of burrs and the like from the protrusion of a pencil.

When forming a connecting recess in the end face of a pencil by the pencil cutting tool 1 having the above configuration, the end of the pencil 50 is inserted while being rotated into the insertion hole 13 of the recess forming part 10 to bring the end face 51 into contact with the step 41, and thereby a recess 52 having a predetermined depth can be formed in the center of the end face 51. Shavings of the pencil 50 produced in the recess forming part 10 are discharged through the discharge part 12 and stored in the casing 4.

Figure 6:
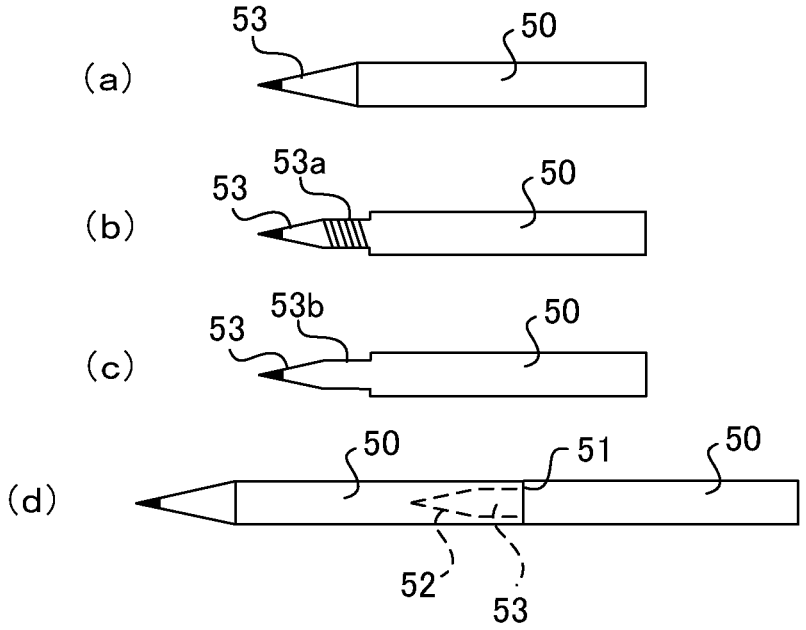
FIG. 6 is a side view showing the process of connecting a plurality of pencils using the pencil cutting tool shown in FIG. 1.

On the other hand, the protrusion of a pencil for insertion into the recess 52 can be formed by the protrusion forming part 20 and the protrusion smoothing part 30 of the pencil cutting tool 1. That is to say, a tip 53 of the pencil 50 shown in FIG. 6(*a*) is inserted into the protrusion forming part 20 and rotated to thereby partially form a shaved part 53*a* on the tip 53 as shown in FIG. 6(*b*), then burrs and the like produced on the shaved part 53*a* are removed in the protrusion smoothing part 30 to thereby form a smoothed part 53*b* as shown in FIG. 6(*c*), and it is thus possible to form the tip 53 into a protrusion that can be inserted into the recess 52. Attaching the resulting protrusion 53 of the pencil 50 to the recess 52 of another pencil 50 connects short pencils 50, 50 and makes it possible to extend the overall length as shown in FIG. 6(*d*), enabling the pencil 50 to be used to the end.

As for the pencil cutting tool 1 of the present embodiment, the boring blade 40 of the recess forming part 10 has a semicircular cross section, and it is thus possible to easily discharge along the flat surface 40*a* the shavings of the pencil 50 produced when forming the recess 52 and prevent the shavings from building up in the recess 52. Furthermore, since the discharge part 12 of the main body 11 is formed so as to face the flat surface 40*a*, the shavings produced in the insertion hole 13 are compressed as the pencil 50 is inserted, pressed in the normal direction of the flat surface 40*a*, and smoothly discharged through the discharge part 12. Accordingly, even when the recesses 52 are sequentially formed in a plurality of pencils 50, the shavings are unlikely to build up in the insertion hole 13, and the recesses 52 can be formed promptly and easily. While it is preferable that the discharge part 12 is formed to face the entirety of the flat surface 40*a* as in the present embodiment, the discharge part 12 may be formed so as to face a portion of the flat surface 40*a* on the proximal side (on the retaining member 42 side).

The supporting part 52 that supports the boring blade 40 has a semicylindrically cut shape. Accordingly, when the end face 51 of the pencil 50 is brought into contact with the step 41, a space capable of accommodating the shavings is formed below the end face 51 as shown in FIG. 4. Furthermore, since the supporting part 52 has the guiding surface 52*b* that is flush with the flat surface 40*a* of the boring blade 40, the guiding surface 52*b* promotes discharge of the shavings through the discharge part 12, and it is thus possible to form the recess 52 promptly and securely.

Due to the covering member 44 provided for the boring blade 40 and the supporting part 52, the boring blade 40 can be safely attached to and removed from the recess forming part 10 and, also, the positional relationship of the connecting part 44*a* relative to the flat surface 40*a* and the guiding surface 52*b* is fixed, and, accordingly, it is possible to easily position the flat surface 40*a* and the guiding surface 52*b* to face the discharge part 12.

Figure 7:
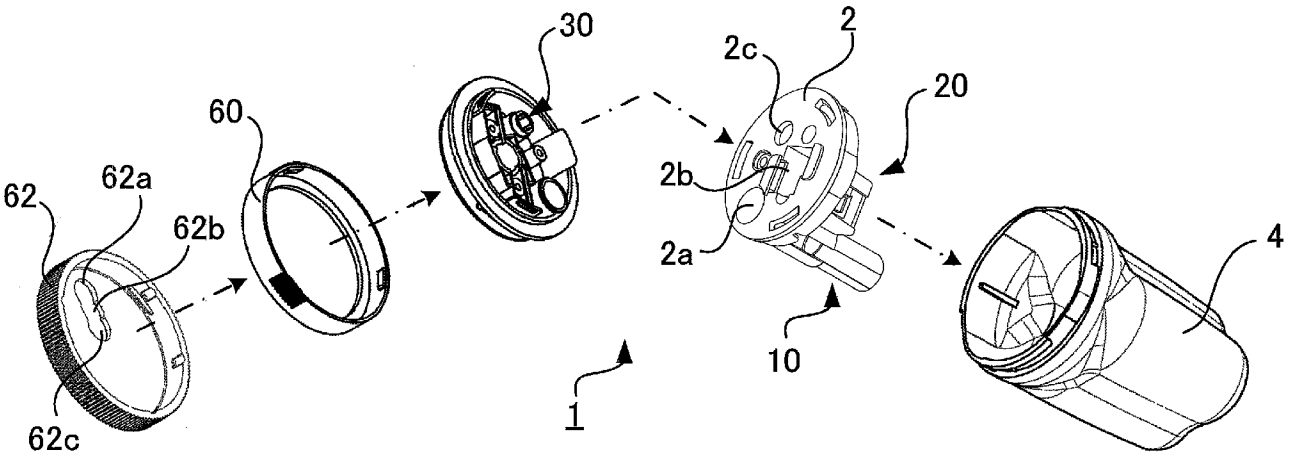
FIG. 7 is an exploded perspective view of a pencil cutting tool according to another embodiment of the present invention.

One embodiment of the present invention has been described in detail above, but the specific aspects of the present invention are not limited to the above embodiment. For example, as shown in FIG. 7, the recess forming part 10, the protrusion forming part 20, and the protrusion smoothing part 30 may be integrated by a disk-shaped lid 2, and the openings 2*a*, 2*b*, and 2*c* of the lid 2, which are respectively in communication therewith, may be disposed at different distances from the center of the lid 2. In this configuration, an outer lid 62 that covers the openings 2*a*, 2*b*, and 2*c* is attached in a rotatable manner via a ring member 60, openings 62*a*, 62*b*, and 62*c* that can be respectively aligned with the openings 2*a*, 2*b*, and 2*c* are formed in the outer lid 62, thereby entrance of foreign matter through the opening 2*a*, 2*b*, and 2*c* can be prevented, and, also, the aesthetic appeal can be enhanced. In FIG. 7, the same components as those in FIG. 1 are given the same reference numbers.

Figure 8:
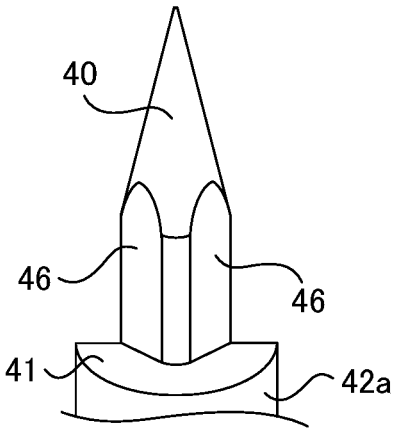
FIG. 8 is a perspective view showing principal parts of a pencil cutting tool according to yet another embodiment of the present invention.
Figure 9:
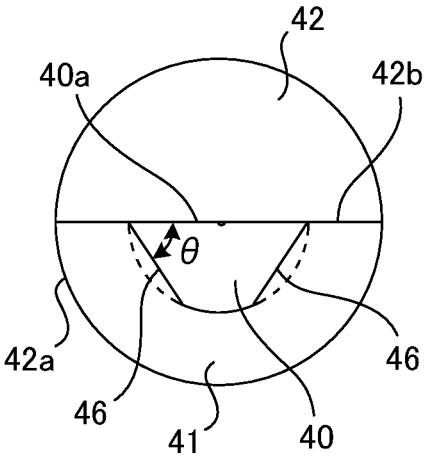
FIG. 9 is a plan view of FIG. 8.

While the boring blade 40 of the above embodiment has a semicircular cross section, the curved outer circumferential surface of the boring blade 40 having a semicircular cross-sectional shape may be partially provided with planar notches 46, 46 (dashed parts in FIG. 9) in the axial direction of the boring blade 40 (i.e., in the axial direction of the insertion hole 13 shown in FIG. 4) as shown in the perspective view and the plan view of FIGS. 8 and 9, respectively. According to this configuration, only the curved surface portion of the outer circumferential surface of the boring blade 40 excluding the notches 46, 46 rotationally slides on a pencil when forming a recess in the pencil, and, thus, frictional resistance produced between the boring blade 40 and the pencil can be reduced. Also, a gap is formed between the boring blade 40 and the pencil by the notches 46, 46 and, accordingly, even when, for example, shavings or the like caught between the boring blade 40 and the pencil makes it difficult to rotate the pencil, discharge of shavings from the gap can be promoted by, for example, reversing the rotational direction. Thus, due to the notches 46, 46, a recess can be easily and securely formed in the pencil. In FIGS. 8 and 9, the same components as those in FIG. 3 are given the same reference numbers.

Figure 10:
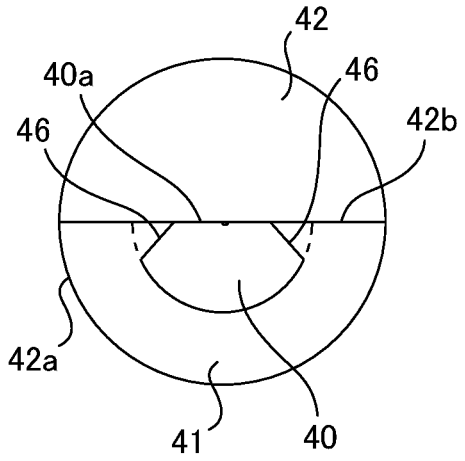
FIG. 10 is a perspective view showing principal parts of a pencil cutting tool according to yet another embodiment of the present invention.
Figure 11:
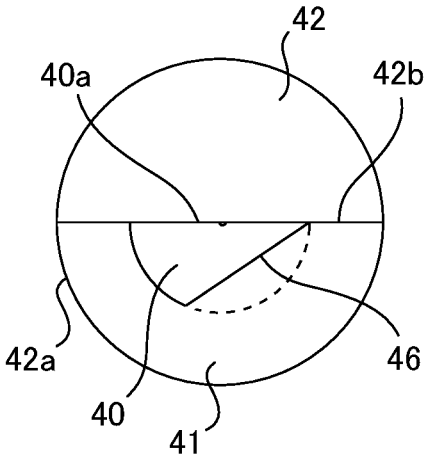
FIG. 11 is a perspective view showing principal parts of a pencil cutting tool according to yet another embodiment of the present invention.
Figure 12:
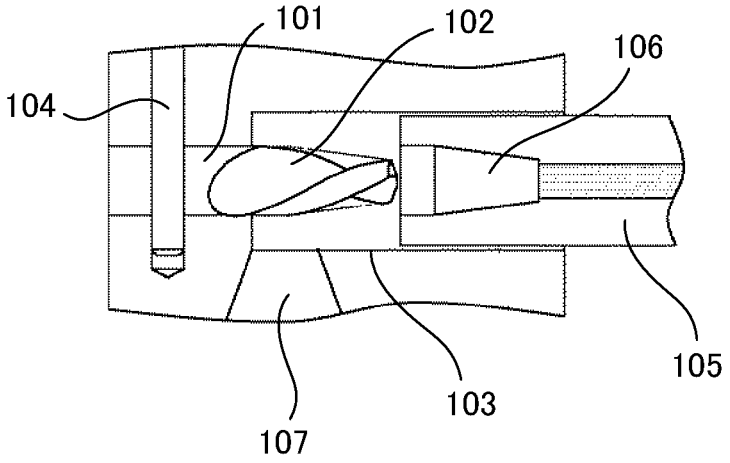
FIG. 12 is a cross-sectional view showing principal parts of a conventional pencil cutting tool.

The size, number, shape, position, and other features of the notches 46 are not limited to those in the configuration of FIGS. 8 and 9, and various modifications can be made. For example, as shown in FIG. 10, the curved outer circumferential surface of the boring blade 40 may be partially cut inward to form the notches 46, 46. Alternatively, as shown in FIG. 11, a single notch 46 may be formed by largely cutting the boring blade 40 along the flat surface 40*a* in a right-left asymmetrical manner. In addition, a large number of notches extending in the axial direction may be formed in the circumferential direction so as to have a serrated cross-sectional shape, or a spiral notch may be formed in the curved outer circumferential surface of the boring blade.

Although an angle θ between the flat surface 40*a* and the notch 46 in the plan view of FIG. 9 is not particularly limited, when the angle θ is excessively large, the area of the notch 46 is small and, accordingly, the effect of forming the notch 46 in the boring blade 40 is unlikely to be provided. On the other hand, when the angle θ is excessively small, the strength of the boring blade 40 is likely to be lowered, also the area of the curved surface excluding the notch 46, which rotationally slides on a pencil and serves as a guide during shaving, is reduced and, accordingly, it is likely to be difficult to smoothly rotate the pencil. Therefore, the angle θ is preferably 40° or greater and 60° or less. In the present embodiment, the angle θ is set at 50°.

REFERENCE SIGNS LIST

1 Pencil cutting tool
10 Recess forming part
11 Main body
12 Discharge part
13 Insertion hole
40 Boring blade
40*a* Flat surface
41 Step
42 Retaining member
42*a* Supporting part
42*b* Guiding surface
44 Covering member
44*a* Connecting part
44*c* Insertion part
46 Notch
50 Pencil
52 Recess

The invention claimed is:

1. A pencil cutting tool comprising a recess forming part for boring a connecting recess in an end face of a pencil, wherein the recess forming part comprises a main body having a cylindrical insertion hole for insertion of an end of the pencil and a boring blade disposed inside the insertion hole so as to come into contact with the end face of the pencil;

the boring blade has a semicircular cross section and a flat surface extending along an axial line of the insertion hole;

the main body has a discharge part that is formed so as to face the flat surface to discharge shavings from the insertion hole;

the pencil cutting tool further comprises a columnar retaining member that is accommodated in the insertion hole and retains the boring blade in the insertion hole, in the retaining member, a supporting part supporting the boring blade is cut in a semicylindrical shape and has a guiding surface that is flush with the flat surface;

a step capable of coming into contact with the end face of the pencil is formed between the supporting part and the boring blade; and the discharge part extends to a position where the discharge part faces the guiding surface.

2. The pencil cutting tool according to claim 1, further comprising a cylindrical covering member that accommodates the boring blade and the supporting part, wherein the covering member has a semicircular insertion part into which the boring blade and the supporting part are capable of being inserted, and has a connecting part that is in communication with the discharge part in a position where the connecting part faces the flat surface and the guiding surface.

3. The pencil cutting tool according to claim 1, wherein seen in the axial line of the insertion hole, the semicircular cross section is composed with a curved outer circumferential surface and the flat surface, and a planar notch, which extends along the axial line, is formed on the curved outer circumferential surface by cutting out a portion of the curved outer circumferential surface.

4. The pencil cutting tool according to claim 3, wherein seen in the axial line of the insertion hole, the semicircular cross section is composed with a curved outer circumferential surface and the flat surface, and a planar notch, which extends along the axial line, is formed on the curved outer circumferential surface by cutting out a portion of the curved outer circumferential surface.

* * * * *